US005870921A

United States Patent [19]

Piccinin et al.

[11] Patent Number: 5,870,921

[45] Date of Patent: Feb. 16, 1999

[54] EXTRUSION DIE FOR SEMI-HOLLOW AND HOLLOW EXTRUDED SHAPES AND TUBE

[76] Inventors: Gabriel Piccinin, 8 Glembourne Park Drive, Unionville, Ontario, Canada, L3R 2L6; Luigi Ingraldi, 72 Thomson Breek Blvd., Woodbridge, Ontario, Canada, L9H 1B7

[21] Appl. No.: 903,995

[22] Filed: Jul. 31, 1997

[51] Int. Cl.[6] ..... B21C 25/04

[52] U.S. Cl. ..... 72/269; 72/467; 72/478

[58] Field of Search ..... 72/264, 269, 283, 72/478, 479, 467

[56] References Cited

U.S. PATENT DOCUMENTS

| | | | |
|---|---|---|---|
| 2,814,071 | 11/1957 | Allan et al. . | |
| 3,783,663 | 1/1974 | Prajsner et al. | 72/283 |
| 3,963,403 | 6/1976 | Hughes et al. . | |
| 4,148,207 | 4/1979 | Stump . | |
| 4,161,112 | 7/1979 | Stump | 72/479 |
| 4,983,347 | 1/1991 | Rahn . | |
| 5,061,163 | 10/1991 | Kennedy | 72/269 |

FOREIGN PATENT DOCUMENTS

| | | | |
|---|---|---|---|
| 61-209719 | 9/1986 | Japan | 72/269 |
| 62-263822 | 11/1987 | Japan | 72/269 |
| 4-66216 | 3/1992 | Japan | 72/269 |
| 567521 | 8/1977 | U.S.S.R. | 72/269 |
| Wo 97/02910 | 1/1997 | WIPO . | |

OTHER PUBLICATIONS

Design and Correction of Hollow Dies in Europe, pp. 369–383. Abstract—Luigi Ingraldi, Vincenzo, Mario Padersoli.

Advanced Design and Manufacture of Hollow Dies or Improved Extrusion Speeds, pp. 207–211, Abstract—Paul H. Robbins.

Die Design and Die Correction as Affected by Pullers, pp. 17–19 Abstract—Gunar Bilén.

Robbins, "Advanced Design and Manufacture of Hollow Dies or Improved Extrusion Speeds" pp. 207–209 earlier than Jul. 31, 1997.

Ingraldi et al., "Design and Correction of Hollow Dies in Europe" earlier than Jul. 31, 1997.

Bilén, "Die Design and Die Correction as Affected by Pullers" earlier than Jul. 31, 1997.

*Primary Examiner*—Joseph J. Hail, III
*Assistant Examiner*—Ed Tolan
*Attorney, Agent, or Firm*—Young & Basile, P.C.

[57] ABSTRACT

An extrusion die for use in producing aluminum alloy articles of extruded shapes or tube having a void with defined internal dimension, said die comprising:

i) a die plate with at least one die cavity defined by a first die bearing surface which defines an external shape for such extruded article;

ii) an extruding mandrel secured in said die cavity and having a second die bearing surface which defines an internal shape for such extruded void;

iii) a truing mandrel positioned beyond said mandrel second die bearing surface for correcting internal shape of such void and providing such defined internal dimension, said truing mandrel having a forming surface defining an external dimension relative to an external dimension of said extruding mandrel for correcting of internal shape where said truing mandrel external dimension is at least equal to a lower limit for finish tolerance on such internal dimension, said truing mandrel forming surface being spaced from said extruding mandrel bearing surface by a reduced portion;

iv) said extruding mandrel bearing surface, by virtue of said truing mandrel, being shorter than a normal extruding mandrel bearing surface to provide an extruded shape or tube with better tolerance while extruding at higher speeds with less temperature build up at said extrusion die.

21 Claims, 7 Drawing Sheets

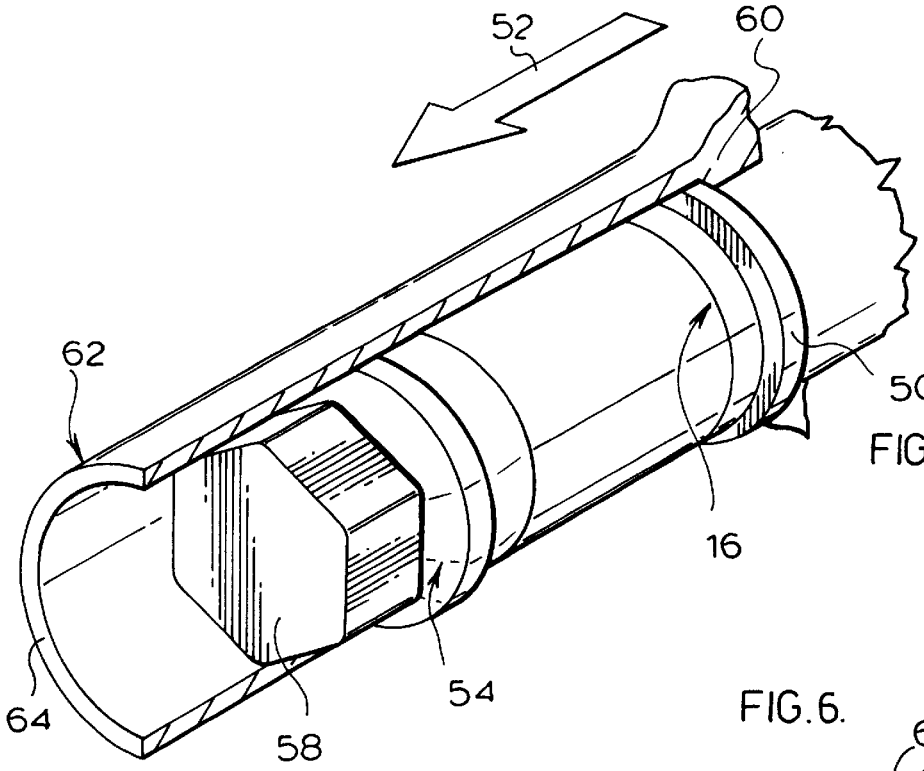
FIG. 5.
FIG. 6.
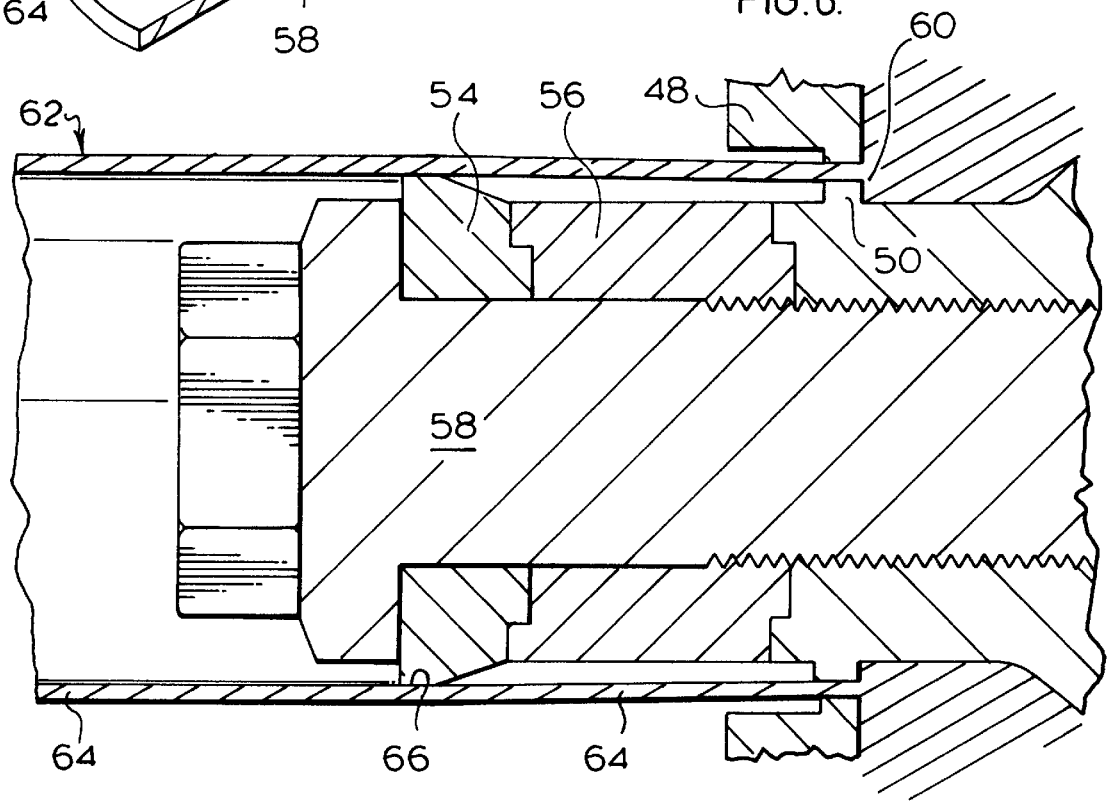

EXTRUSION DIE FOR SEMI-HOLLOW AND HOLLOW EXTRUDED SHAPES AND TUBE

FIELD OF THE INVENTION

This invention relates to methods and apparatus for use in extruding aluminum alloy articles of extruded shapes and tube with more accurate internal dimensions for a void in the extruded article.

BACKGROUND OF THE INVENTION

In the aluminum alloy extrusion business, there are a variety of extruded articles of various cross-sections. There has been an attempt to standardize language used to describe various extruded article configurations and such standardized language will be used here in describing the types of articles the invention is useful in extruding. Generally an extruded shape does not include a rod, bar or tube. A semi-hollow extruded shape includes a void which has a gap along its extruded length. A hollow extruded shape has a closed void along its extruded length. An extruded tube is of almost any cross-sectional shape such as round, square, rectangular, hexagonal, octagonal or elliptical where the tube is generally of uniform wall thickness.

Continuing efforts are being made to improve the dimensions of extruded semi-hollow and hollow shapes and tube in order to broaden their use in a variety of applications. The greater the dimensional accuracy of the extrusion, the greater the opportunity there is to replace milled pieces with extruded pieces of various aluminum alloys. There is also a continuing effort to enhance the speed of aluminum alloy extrusion while minimizing scrap and reducing die temperature build up. Such advances are described by Paul Robbins in "Advanced Design and Manufacture of Hollow Dies or Improved Extrusion Speeds" *Proceedings of the 6th International Aluminum Extrusion Technology Seminar* Volume 2, May 14–16 1996- Chicago Ill. Various die designs are discussed which enhance the speed of extrusion while limiting the temperature of extrusion. One of the difficulties encountered in increasing extrusion speed is mandrel deflection which is discussed by Luigi Ingraldi in "Design and Correction of Hollow Dies in Europe" *Proceedings of the 5th International Aluminum Extrusion Technology Seminar* Volume 1, May 19–22, 1992 Chicago, Ill. Improved mandrel designs reduce mandrel deflection and hence provide a better quality product.

When drawing the extruded product, problems are described in respect of U.S. Pat. No. 4,148,207 and Gunar Bilen in "Die Design and Die Correction as Affected by Pullers" *Proceedings of the 4th International Extrusion Technology Seminar*, Volume 2, Apr. 11–14, 1988, Chicago, Ill. For purposes of cold drawing, the mandrel or the die may be provided with a tapered section to improve the quality of the drawn product. As described in the article by Bilen pullers cause a significant problem with extended mandrel designs. Excessive bearing surface on the mandrel can cause the section to stick to the mandrel surface when puller force is applied, which can disastrously affect the shape of the extrusion.

PCT published application WO 97/02910 describes an extrusion die for hollow extrusions where the die cavity includes a preform chamber which allows the die to operate at increased velocities.

In the field of plastic extrusion various post-forming operations of the extruded plastic tube are described in U.S. Pat. Nos. 2,814,071; 3,963,403 and 4,983,347. Although the devices of these particular U.S. Patents function reasonably well for various purposes in post-forming of plastic articles, such post-treatment may be readily conducted on plastics because of their flexibility and inherent elasticity.

From a practical stand point, most aluminum extruders attempt to improve the accuracy of the die so as to reduce scrap, increase velocity of extrusion and control die temperature. However, post-forming operations are still necessary and which are carried out at a different station. Such post-forming operations include drawing, sizing, rolling, annealing, straightening and the like to achieve the desired accuracy with respect to semi-hollow and hollow extruded shapes and tube. Such additional post-forming techniques are expensive, time consuming and involve considerably more labor.

In accordance with an object of an aspect of this invention, an aluminum extrusion process and an aluminum extrusion die are provided which achieve the objectives of increasing extrusion speed, controlling extrusion die temperature and providing a hollow extrusion with internal dimensions having enhanced tolerances.

SUMMARY OF THE INVENTION

In accordance with an aspect of the invention, an extrusion die for use in producing aluminum alloy articles of extruded shapes or tube, having a void with defined internal dimension comprises:

i) a die plate with at least one die cavity defined by a first die bearing surface which defines an external shape for such extruded article;

ii) an extruding mandrel secured in the die cavity and having a second die bearing surface which defines an internal shape for such extruded void;

iii) a truing mandrel positioned beyond the mandrel second die bearing surface for correcting internal shape of such void and providing such defined internal dimension, the truing mandrel having a forming surface defining an external dimension relative to an external dimension of the extruding mandrel for correcting of internal shape where the truing mandrel external dimension is at least equal to a lower limit for finish tolerance on such internal dimension, the truing mandrel forming surface being spaced from the extruding mandrel bearing surface by a reduced portion;

iv) the extruding mandrel bearing surface, by virtue of the truing mandrel being shorter than a normal extruding mandrel bearing surface to provide an extruded shape or tube with better tolerance while extruding at higher speeds with less temperature build up at said extrusion die.

In accordance with another aspect of the invention, a method for extruding aluminum alloy articles of extruded shapes or tube having a void with defined internal dimension method comprises:

i) extruding aluminum alloy through a die cavity to produce the article with at least one void; and ii) correcting internal dimensions of the void immediately adjacent the die cavity by passing the extrusion over a truing mandrel to correct void internal dimensions while the extrusion is at forming temperatures.

BRIEF DESCRIPTION OF THE DRAWINGS

Various embodiments of the invention are shown in the drawings wherein:

FIG. 5 is a schematic of the hollow extruded shape passing over the truing mandrel;

FIG. 6 is an enlarged view of the section of FIG. 4 showing the hollow extruded shape passing from the die cavity to the truing mandrel;

DETAILED DESCRIPTION OF THE PREFERRED EMBODIMENTS

Figure 1:
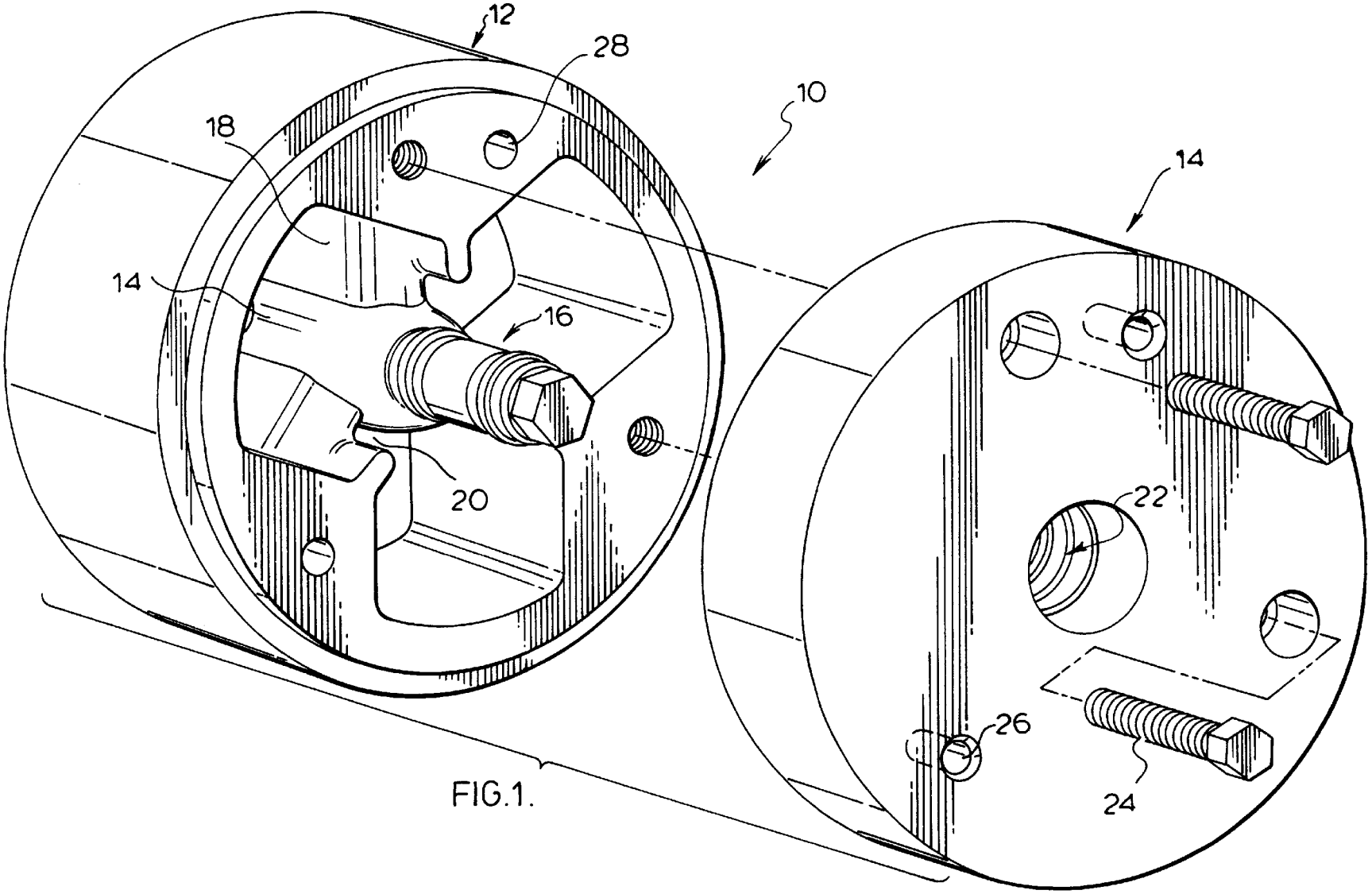
FIG. 1 is an exploded perspective view of a hollow aluminum extrusion die having a forming section connected to the extrusion mandrel.

An aluminum alloy extrusion die for producing a hollow extruded shape is shown in FIG. 1. The extrusion die generally designated 10 comprises a die body 12 and a die plate 14. The die body 12 has on its interior a plurality of legs 14 which support a mandrel 16. The upstream portions 18 of the legs split the aluminum into flows of aluminum which are rejoined in the weld area 20. The aluminum flows between the mandrel 16 and the die plate 14 of the die cavity. The die plate 14 is assembled to the die body 12 by the use of bolts 24 and locating knobs 26 which fit one way within the recesses 28.

Figure 2:
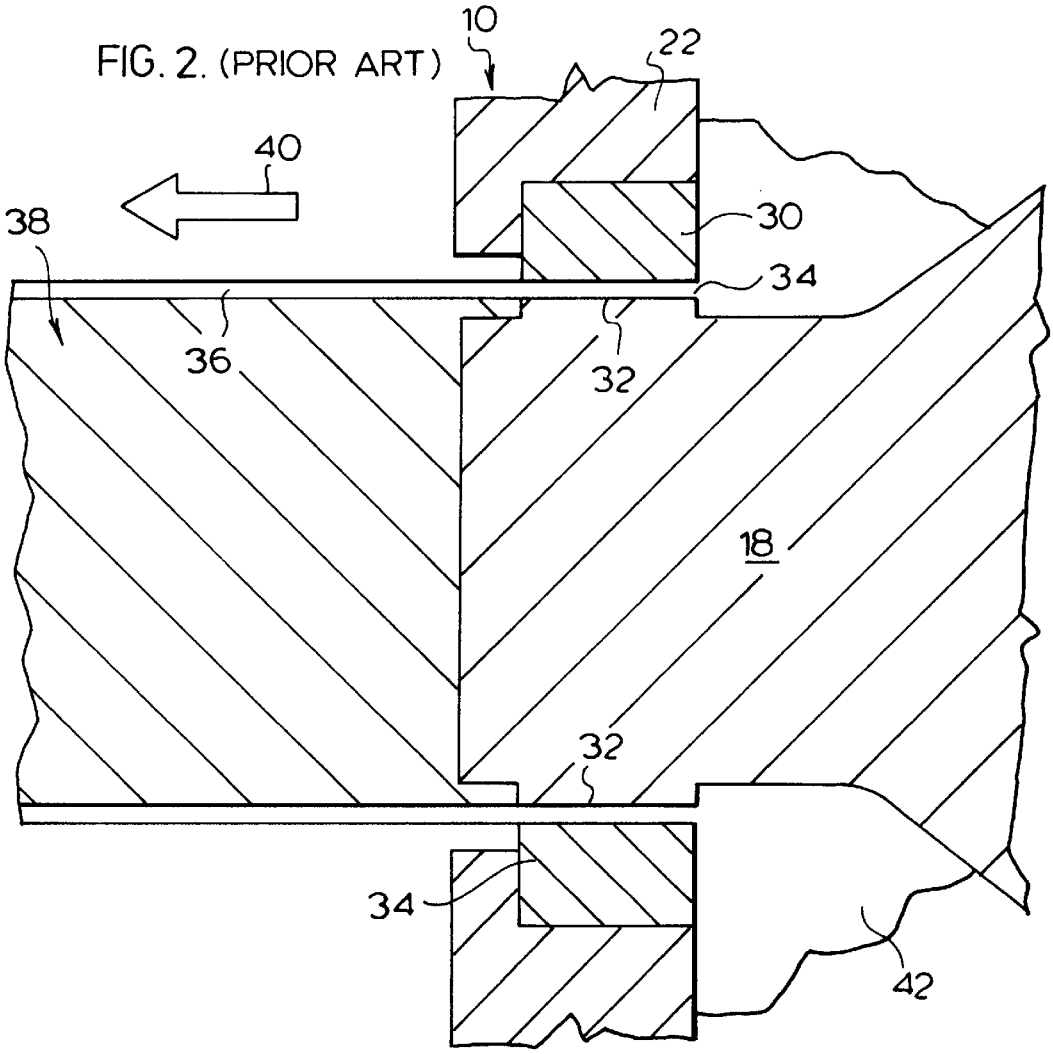
FIG. 2. (PRIOR ART)
FIG. 2 is a section through a hollow aluminum extrusion die of the prior art.
Figure 3:
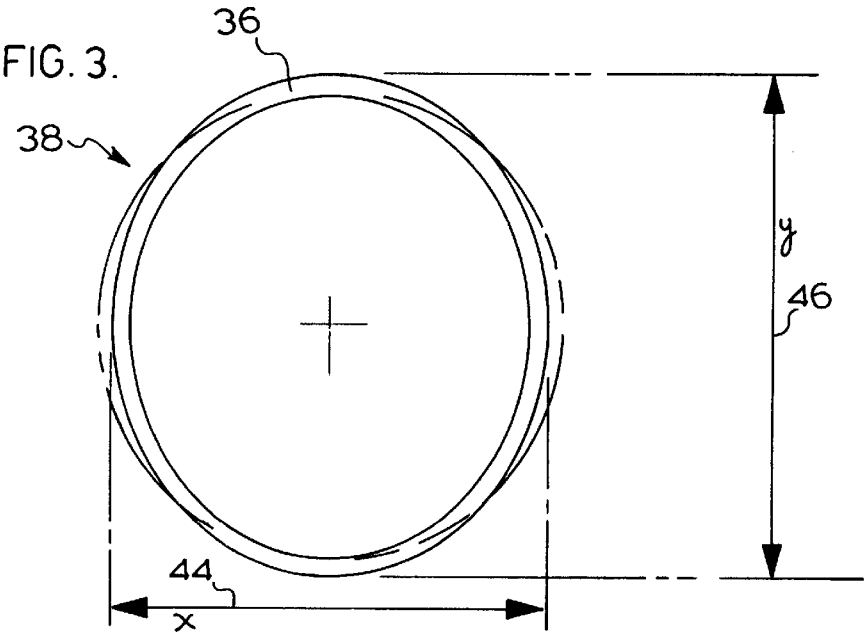
FIG. 3 is a section through a hollow extruded shape showing ovality characteristics of aluminum extrusion from prior art devices.

In a conventional hollow extrusion die design such as shown in FIG. 2, the mandrel shaft 18 is supported within the die cavity 22 where the die cavity has a first bearing surface 30 and the mandrel shaft 18 has a second bearing surface 32. The space 34 between the first and second bearing surfaces defines the thickness of the wall 36 of the extruded shape or tube 38 as it advances in the direction of arrow 40 away from the die 10. The aluminum 42 is extruded through the aperture defined between the first and second die surfaces 30 and 32 where an increased length in the direction of arrow 40 for the bearing surfaces 30 and 32 increases the accuracy of interior dimensions of the extruded shape or tube 38. It is generally understood that at slower extrusion speeds and with extended bearing surfaces 30 and 32, the accuracy of the dimensions for the extruded shape or tube 38 are improved. However, it is accepted in the industry that, with hollow extruded shapes and extruded tube, a tolerance of normally ±0.010 is usual in respect of the dimensioning of the extruded shape or tube. As shown in FIG. 3 in the X and Y directions the respective dimensions 44 and 46 for an extruded tube may vary ±0.010 inches. If this tolerance is not acceptable for the particular use, it is understood that in accordance with existing techniques using the prior art dies of FIG. 3, various drawing, sizing, roll correcting and straightening post-forming techniques may be used at a separate station to bring the tolerance of the hollow extrusion to within the desired range. The difficulty however with such post-forming techniques is that any significant expansion of the tube or extruded shape in either or both of the X and Y directions may weaken the extrusion particularly along weld lines which are formed in the weld areas 20 of the die as shown in FIG. 1. Such straightening of the extrusion can induce fissure cracks, particularly in the weld area such that the extruded item structurally fails at stress levels well below specified limits. In order to compensate for such fissure cracks, the wall thickness of the extruded article is increased to provide a safety margin for the extruded article and hence adding to overall costs in extrusion time, extrusion press size and the like.

Figure 4:
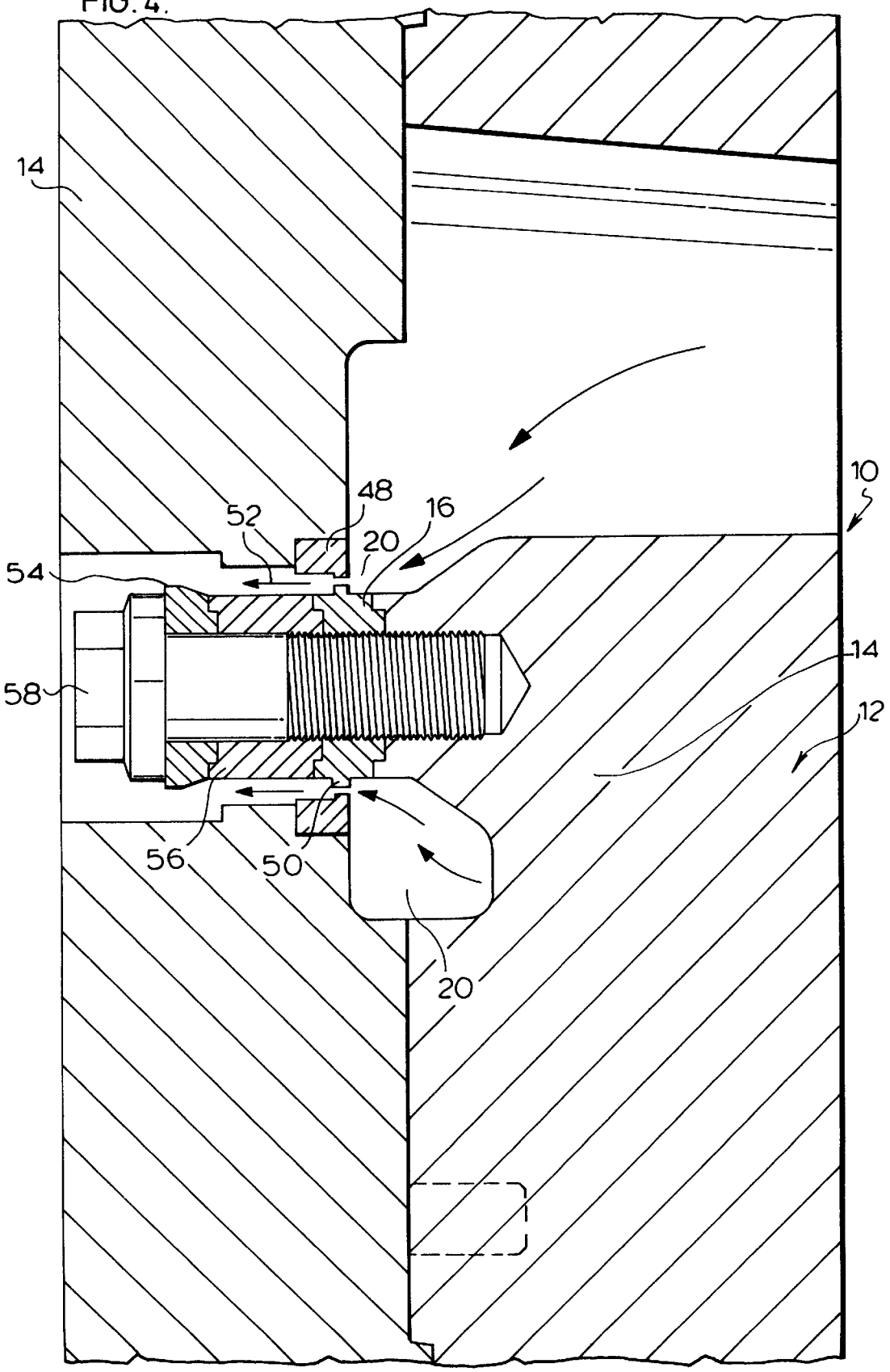
FIG. 4 is a section through the assembled aluminum extrusion die of FIG. 1.

FIG. 4 is a section through the extrusion die of this invention which includes a truing mandrel adjacent or just beyond the extrusion mandrel. As with the conventional die 10, the die body 12 has the leg portions 14 with welding areas 20. The die plate 14 carries the first die bearing surface element 48. The legs 14 carry the mandrel 16 with its post portion 18 and with die bearing surface element 50.

The aluminum is extruded out of the die cavity in the direction of arrow 52 where it proceeds to a truing mandrel 54 which in this embodiment is spaced from the extrusion mandrel 16 by a reduced spacer 56 and which is connected to the die body 12 by way of bolt 58 threaded into mandrel post 18. In accordance with this invention a truing mandrel 54 is provided to correct the interior dimensions of the extruded article. It has been surprisingly found that one can position a truing mandrel adjacent an extrusion mandrel to correct the interior dimensions of the hollow shape and depending upon the extruded shape or tube, at the same time correct the outside dimensions of the shape. It has been surprisingly found that the truing mandrel does not slow down the speed of extrusion and does not increase the temperature of the extrusion die. To the contrary it has been found that the use of a truing mandrel permits the increase of extrusion speeds by virtue of reducing the length of the bearing surfaces 48 and 50 of the die cavity and the mandrel. Any correcting of the dimensions of the extruded shape are conducted at the truing mandrel positioned just downstream of the extrusion mandrel so that the aluminum alloy is still at sufficiently elevated temperature to permit post-forming of the aluminum alloy without inducing stress cracks, fissure cracks or the like and more particularly avoiding inducing weakness in the welds formed in areas 20 of the extrusion die.

As shown in FIG. 5, the mandrel 16 has the bearing surface component 50 which shears the metal in region 60 as the aluminum alloy is extruded between the bearing surfaces of the die and the mandrel in the direction of arrow 52. In the particular embodiment of FIG. 5, the extruded shape is a tube 62 where the wall 64 is of reasonably consistent thickness. The tube 62 after it emerges beyond the mandrel 16, passes over the truing mandrel 54 to correct the internal shape of the tube 62. This aspect of the invention is shown in more detail in FIG. 6 where the truing mandrel 54 has a forming surface 66, the dimension of which is within the desired tolerance for the internal dimensions of the tube. The truing mandrel 54 is located slightly downstream of the extrusion mandrel 16 to allow the wall 64 of the aluminum extrusion to stabilize in the open environment before passing over the forming surface 66 of the truing mandrel 54. Such spacing of the truing mandrel relative to the extrusion mandrel is such that the aluminum extrusion does not cool down below its forming temperature, that is the material may still be worked at the truing mandrel die 54 without inducing stress cracks, fissure cracks or weakening of the welds in the continuous extrusion.

Figure 7:
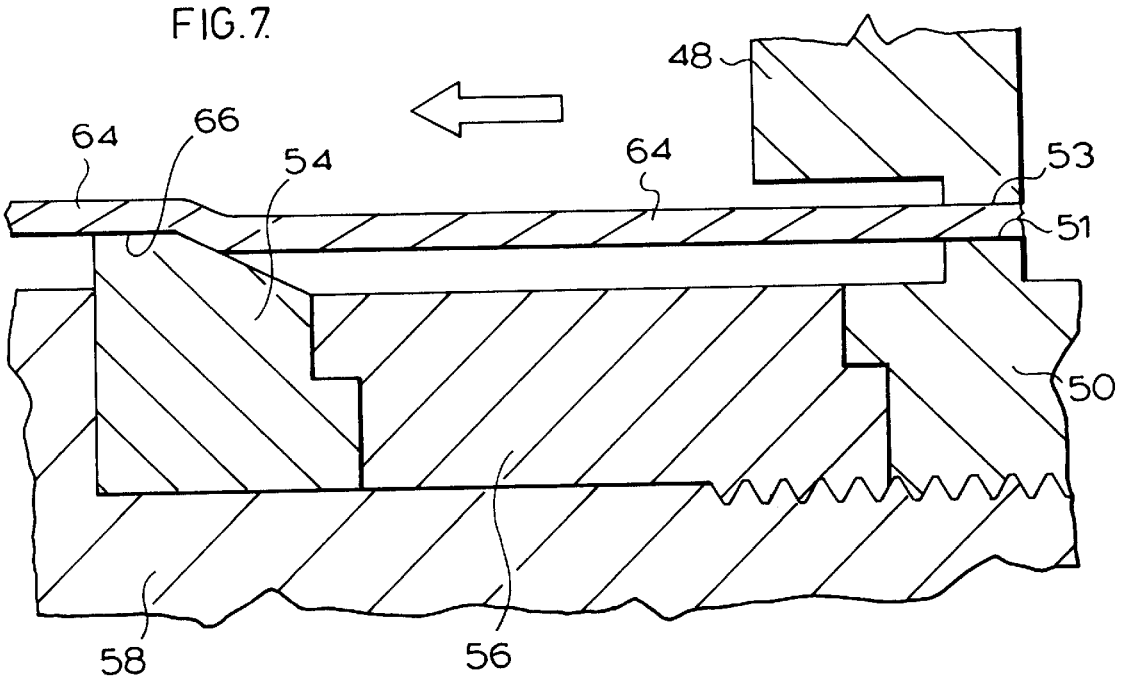
FIG. 7 shows an alternative embodiment for the truing mandrel relative to the die cavity.

The truing mandrel 54 may be dimensioned to be the same size as the extrusion mandrel 16 or to be slightly smaller or larger than the overall size of the extrusion mandrel. As shown in FIG. 6, the truing mandrel 54 is of the same diameter as the bearing surface component 50 of the extrusion mandrel 16. Depending upon the extent to which it is desired to correct the internal dimensions of the hollow shape, the truing mandrel 54 may be slightly smaller than the extrusion mandrel 16 providing the size of the truing mandrel is still sufficient relative to the extrusion mandrel to place the internal dimensions within the desired tolerance. Alternatively, as shown in FIG. 7, the truing mandrel 54 may have a diameter slightly greater than the extrusion mandrel 16 as defined by the bearing surface 51. As shown in more detail, the tube wall thickness 64 is defined by the space between bearing surface 51 of element 50 of extrusion mandrel 16 and bearing surface 53 of the die cavity element 48. From the extrusion mandrel 16 to the forming mandrel 54, the reduced spacer 56 does not contact the extruded wall 64. As the extruded shape contacts the truing mandrel 54 the forming surface 66 slightly expands the wall 64 since the wall 64 is still at forming temperature. Such expansion of the wall does not induce weakness in the wall material and at the same time ensures that the interior dimension of the tube 62 is within the desired tolerance.

Figure 8:
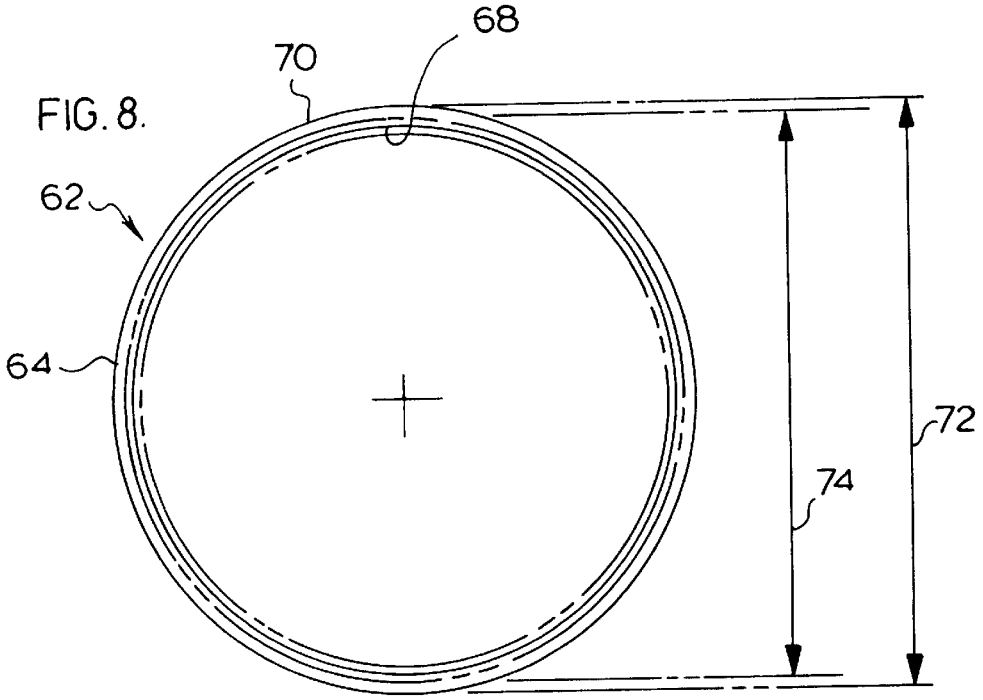
FIG. 8 is a section through the hollow extruded shape formed by the apparatus of this invention.

As shown in FIG. 8, the tube 62 has a consistent wall thickness 64 where the truing mandrel 54 expands both the internal dimension 68 and the external dimension 70 to the extent represented by the difference in arrows 72 and 74. This truing of the outside wall dimension is due to the wall thickness 64 being consistent. Both the internal dimension 68 and the exterior dimension 70 are corrected to within tolerance as determined by the selected size for the truing mandrel 54.

The component aspect of the truing mandrel provides several advantages which were previously not thought possible. The truing mandrel 54 may be made of a material different from the extrusion mandrel 50. The bolt 58 may be used simply to connect all components to the die body. As shown in FIG. 4, the extrusion mandrel 16 may be of a material different from the extrusion body. Alternatively, the extrusion mandrel and the truing mandrel could be turned from the same material as the die body. The reduced portion 56 between the extrusion mandrel and the truing mandrel may also be of a different material to accommodate temperature fluctuations in the material or of high heat capacity or internally cooled, to provide a degree of cooling for the material as it passes from the extrusion mandrel to the truing mandrel. The reduced portion 56 does not contact the walls of the extrusion to allow thereby the extruded material in this area to stabilize after being released from the pressure from within the extrusion press.

Figure 9:
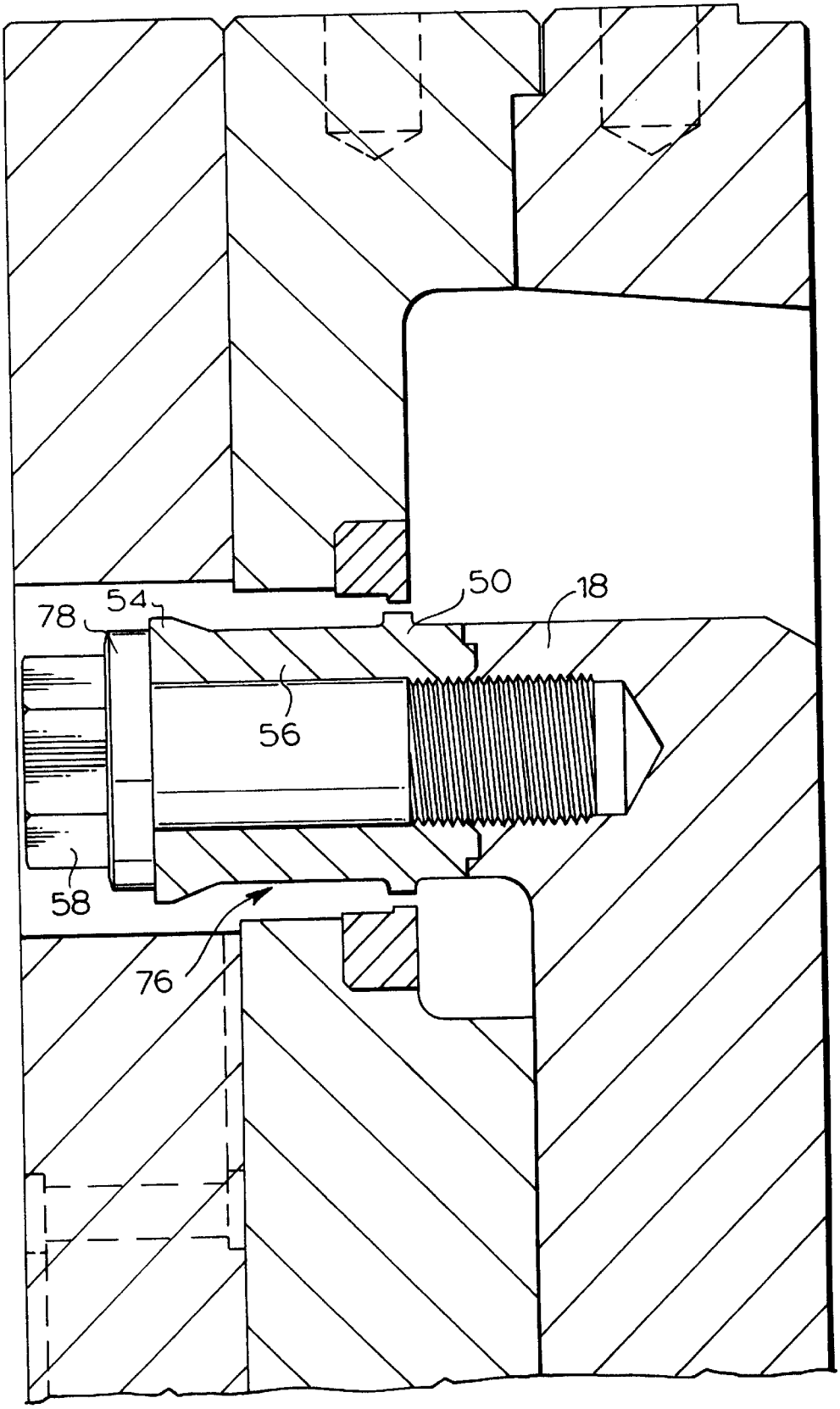
FIG. 9 is a section through the assembled aluminum extrusion die showing an alternative embodiment for the truing mandrel component.

It is appreciated that various combinations of truing mandrel components may be provided in positioning the truing mandrel on the post portion 18. In FIG. 4, a three component system for the extrusion mandrel bearing surface, the spacer and the truing mandrel was shown. In FIG. 6, the bearing surface for the extrusion mandrel was integral with the post 18 where components 56 for the reduced portion and 54 for the truing mandrel were separate components. In FIG. 9, we show yet a further alternative where the extrusion mandrel bearing surface component 50, the reduced portion 56 and the truing mandrel forming surface 54 are all from an integral component 76. The integral component 76 is secured to the post 18 by the usual bolt 58 with washer 78. It is also understood that the components 50, 54 and 56 may be machined integrally from the post portion 18, or other combinations of the three elements or less may be made in providing the respective extrusion mandrel bearing surface, truing mandrel forming surface and reduced portion.

It is also understood that this design permits retrofitting of existing extrusion dies with a truing mandrel to enhance the accuracy of the extrusion die in providing an extrusion within a more limited tolerance. It is understood that with the use of a truing mandrel, tolerances of ±0.003 inches for aluminum extrusion dimensions may be achieved which was not thought possible with the prior art extrusion systems. Such accuracy now opens the field of use of aluminum extrusions in a variety of other areas which were previously reserved for milled surfaces. It is also understood that the use of the truing mandrel enhances or by virtue of the truing mandrel permits the selection of a bearing surface for the extrusion mandrel which is considerably shorter than what was normally thought possible. With prior art system such as shown in FIG. 2, the bearing length was normally equal to twice the wall thickness of the extruded shape. Now the bearing length can be less than the thickness of the wall of the extruded shape or approximately equal to the wall thickness depending upon the particular parameters for the extrusion. By having a shorter bearing length, the speed of extrusion may be increased while at the same time not adding appreciably to the overall temperature build up in the die. Hence a better quality extrusion can be produced in terms of surface finish and reduced tolerance. The truing mandrel may be made of a material to polish the interior surface of the hollow shape during extrusion. It is generally understood that during cooling there is approximately 1% shrinkage of the material so that this percentage may be factored into the overall selection of the truing mandrel design. It is understood that the truing mandrel may be supplied to the consumer in various sizes to accommodate various conditions in the extrusion of the selected shape depending upon the particular tolerance desired. Depending upon the extrusion conditions and desired interior void finish, the forming mandrel may be made from or at least have a forming surface made from carbide, steel, ceramic, hot works steel such as H13 steel, high speed steel and powdered metals. By providing the extrusion mandrel and forming mandrel in components, such variation in materials selection is readily permitted.

Figure 10:
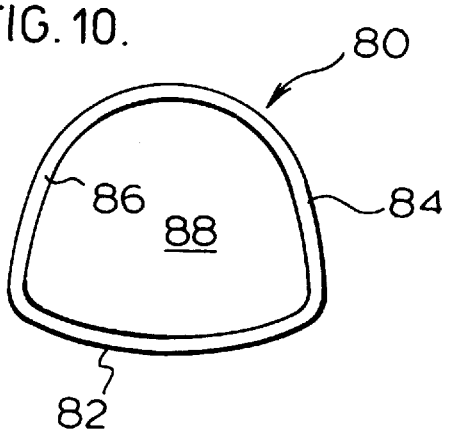
FIGS. 10, 11 and 12 are sections through various alternative embodiments for extruded tube and hollow and semi-hollow extruded shapes.
Figure 11:
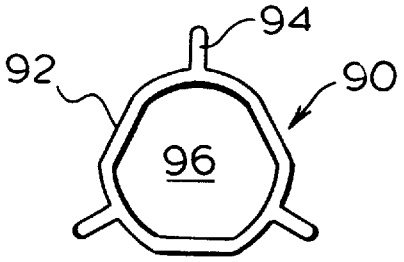
Figure 12:
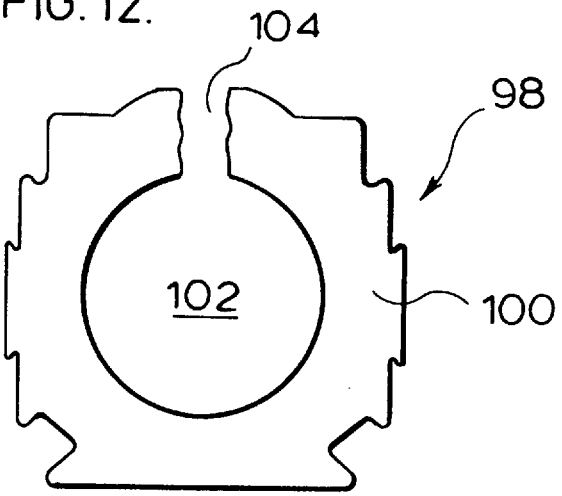

With these principles in mind, the combination extrusion mandrel and truing mandrel of this invention may be used to extrude a variety of shapes such as shown in FIG. 10. The extruded tube 80 has a first arcuate portion 82 and a second arcuate portion 84. The tube is of consistent wall thickness 86 with an enclosed void 88. In FIG. 11, a hollow extruded shape 90 is also shown. The shape has essentially a round cross-section 92 with three outwardly extending fins 94. The hollow extruded shape has an enclosed void 96. In FIG. 12, a semi-hollow extruded shape 98 is shown with thick sidewalls 100 and a void 102 which is open by gap 104. In all of these embodiments, a truing mandrel may be used to enhance extruded finish on the interior of the void and as well improve the manufactured tolerance of the internal dimensions of the void. Additionally, with respect to FIG. 12, a truing mandrel may be used to provide a gap 104 with dimensioning within a desired reduced tolerance.

Although preferred embodiments has been described herein in detail, it is understood by those skilled in the art that variations may be made thereto without departing from the spirit of the invention and scope of the appended claims.

We claim:

1. An extrusion die for use in producing aluminum alloy articles of extruded shapes or tube having a void with defined internal dimension, said die comprising:

i) a die plate with at least one die cavity defined by a first die bearing surface which defines an external shape for such extruded article;

ii) an extruding mandrel secured in said die cavity and having a second die bearing surface which defines an internal shape for such extruded void, said second die bearing surface opposing said first die bearing surface;

iii) a truing mandrel positioned beyond said mandrel second die bearing surface for correcting internal shape of such void and providing such defined internal dimension, said truing mandrel having a forming surface defining an external dimension relative to an external dimension of said extruding mandrel for correcting of internal shape where said truing mandrel external dimension is at least equal to a lower limit for finish tolerance on such internal dimension, said truing mandrel forming surface being spaced from said extruding mandrel bearing surface by a reduced portion and having an internal dimension equal to or greater than said external dimension of said second die bearing surface;

iv) said extruding mandrel bearing surface, by virtue of said truing mandrel, being shorter than a normal extruding mandrel bearing surface to provide an extruded shape or tube with better tolerance while extruding at higher speeds with less temperature build up at said extrusion die.

2. An extrusion die of claim 1 wherein said truing mandrel forming surface has an external dimension greater than said external dimension of said second die bearing surface, said external dimension of said forming surface enlarging such internal dimension of such void within an upper limit for finish internal tolerance of such article where such enlargement of such extrusion occurs while such aluminum extrusion is at forming temperatures in the range of 700° F. to 1100° F.

3. An extrusion die of claim 1 wherein said truing mandrel is releasably connected to said extrusion mandrel thereby providing for interchange of said truing mandrel.

4. An extrusion die of claim 3, wherein said truing mandrel is formed of a metal alloy different than the metal alloy of said extrusion mandrel.

5. An extrusion die of claim 4, wherein said truing mandrel is formed of a carbide, steel, ceramic, hot work steels, high speed steel and powdered metals.

6. An extrusion die of claim 3, wherein said truing mandrel has two components comprising a reduced portion and a separate forming surface portion, said truing mandrel being connected to said extrusion mandrel.

7. An extrusion die of claim 1 for extruding a tube wherein said extrusion mandrel bearing surface is less than twice the wall thickness of a tube to be extruded.

8. An extrusion die of claim 7, wherein said bearing surface is approximately equal to the wall thickness of such tube.

9. An extrusion die of claim 7 wherein said truing die corrects internal dimension and external dimension where such extruded tube is of consistent wall thickness along its length.

10. An extrusion die of claim 1 for extruding a hollow extruded shape having varying wall thickness about said void.

11. An extrusion die of claim 1 for extruding a semi-hollow extruded shape having a void with a gap.

12. A method for extruding aluminum alloy articles of extruded shapes or tube having a void with defined internal dimension, said method comprising:

i) extruding aluminum alloy through a die cavity which has opposing first and second die bearing surfaces to produce said article with at least one void, said second die bearing surface defining void internal dimension;

ii) correcting internal dimensions of said void immediately adjacent said die cavity by passing said extrusion over a truing mandrel after said extrusion exits said die cavity to correct void internal dimensions while said extrusion is at forming temperatures, said truing mandrel has an external dimension equal to or greater than external dimension of said second die bearing surface.

13. A method of claim 12, wherein said correction step realigns walls of said void.

14. A method of claim 12 wherein said correction step expands slightly walls of said void to provide internal dimensions of said void within a predetermined dimensional tolerance.

15. A method of claim 12 wherein said die cavity has an extrusion mandrel with a die bearing surface, said die bearing surface has a length less than twice the thickness of the walls which define said void.

16. A method of claim 15, wherein said extrusion is a tube, said die bearing surface being approximately equal to wall thickness of such tube.

17. A method of claim 15, wherein said step of correcting interior dimension also corrects exterior dimension as determined by a consistent wall thickness.

18. A method of claim 17, wherein said tube is extruded with dimensional tolerance within ±0.005 inches.

19. A method of claim 12, wherein said truing mandrel has a steel carbide surface.

20. A method of claim 12, wherein said extrusion speed is increased while heat build up is controlled.

21. A method of claim 12, wherein said truing mandrel is adjacent said die cavity and corrects void interior dimensions after such extrusion has stabilized from exiting said die cavity.

* * * * *